US011713641B2

(12) United States Patent
Murphy et al.

(10) Patent No.: US 11,713,641 B2
(45) Date of Patent: Aug. 1, 2023

(54) DEBRIS BARRIER FOR RETRIEVABLE DOWNHOLE TOOL USING EXPANDABLE METAL MATERIAL

(71) Applicant: Halliburton Energy Services, Inc., Houston, TX (US)

(72) Inventors: Robert Travis Murphy, Van Alstyne, TX (US); Samuel Martinez, Cedar Hill, TX (US); Michael Linley Fripp, Carrollton, TX (US); Roderick Brand Falconer, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 109 days.

(21) Appl. No.: 17/217,213

(22) Filed: Mar. 30, 2021

(65) Prior Publication Data

US 2022/0316294 A1 Oct. 6, 2022

(51) Int. Cl.
*E21B 33/12* (2006.01)
*E21B 33/129* (2006.01)
*E21B 33/128* (2006.01)

(52) U.S. Cl.
CPC ..... *E21B 33/1208* (2013.01); *E21B 33/1285* (2013.01); *E21B 33/1291* (2013.01)

(58) Field of Classification Search
CPC ..... E21B 33/1208; E21B 33/1291; E21B 33/1285
See application file for complete search history.

(56) References Cited

U.S. PATENT DOCUMENTS

| | | | | |
|---|---|---|---|---|
| 6,302,217 | B1 | 10/2001 | Kilgore et al. | |
| 10,316,614 | B2 | 6/2019 | Fripp et al. | |
| 10,626,695 | B2 | 4/2020 | Fripp et al. | |
| 11,072,992 | B1 * | 7/2021 | Milne | E21B 33/1216 |
| 11,299,955 | B2 * | 4/2022 | Fripp | E21B 33/1208 |
| 2010/0270031 | A1 | 10/2010 | Patel | |
| 2020/0325749 | A1 | 10/2020 | Fripp et al. | |
| 2022/0178222 | A1 * | 6/2022 | Fripp | E21B 33/1208 |
| 2022/0186579 | A1 * | 6/2022 | Pelto | E21B 33/127 |

FOREIGN PATENT DOCUMENTS

| | | | |
|---|---|---|---|
| EP | 0890706 | B1 | 3/2004 |
| WO | 2008063979 | A1 | 5/2008 |

OTHER PUBLICATIONS

PCT/US2021/025101, "International Search Report and Written Opinion", dated Dec. 20, 2021, 10 pages.

* cited by examiner

*Primary Examiner* — Yong-Suk (Philip) Ro
(74) *Attorney, Agent, or Firm* — Kilpatrick Townsend & Stockton LLP

(57) ABSTRACT

A system is described for forming a debris barrier downhole in a wellbore. The system may include a mandrel, a retrievable downhole tool, and a debris ring. The mandrel may be positionable within a wellbore. The retrievable downhole tool may be positionable around the mandrel to perform tasks downhole in the wellbore. The debris ring may include an expandable material positionable around the mandrel to form a debris barrier. The debris barrier may be formed in response to exposing the expandable material to wellbore fluid.

20 Claims, 5 Drawing Sheets

DEBRIS BARRIER FOR RETRIEVABLE DOWNHOLE TOOL USING EXPANDABLE METAL MATERIAL

TECHNICAL FIELD

The present disclosure relates generally to wellbore operations and, more particularly (although not necessarily exclusively), to debris barriers in retrievable downhole tools.

BACKGROUND

Various tools may be deployed downhole in a wellbore and may be retrieved after completing wellbore-related tasks. Some examples of the various tools can include packers, tubing hangers, and the like. The tools may be disposed downhole for an extended period of time for completing the wellbore-related tasks, and, during the extended period of time, sediment or other debris can be disturbed downhole such that the debris settles or accumulate within or around the tools. In some examples, tools disposed downhole that include accumulated debris can be difficult to retrieve, and, in some cases, removing tools that include accumulated debris can cause damage to the wellbore and the downhole tools.

DETAILED DESCRIPTION

Figure 1:
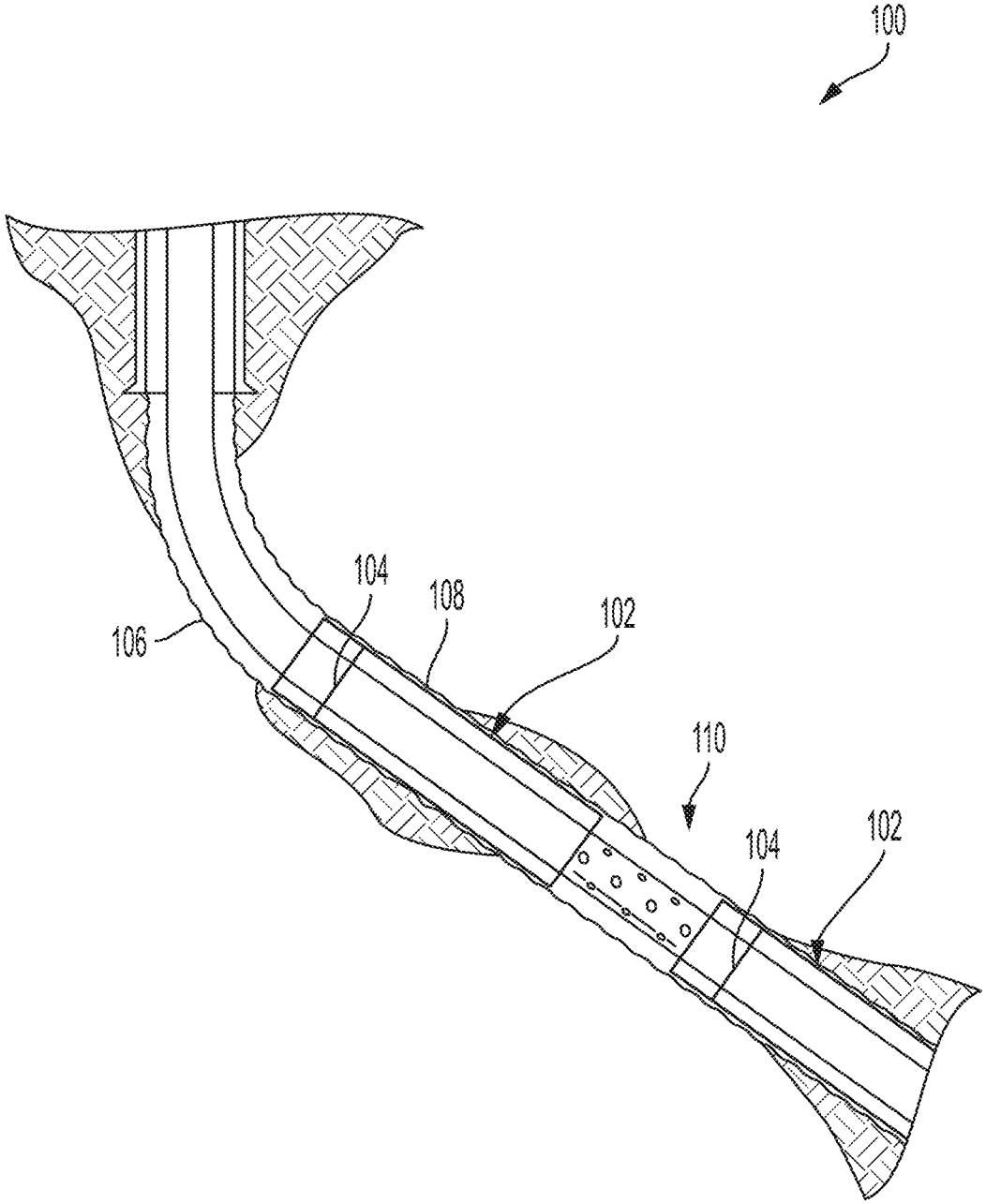
FIG. 1 is a schematic diagram of a set of retrievable downhole tools having at least one debris ring disposed in a wellbore according to one example of the present disclosure.

Certain aspects and examples of the present disclosure relate to forming a debris barrier on a retrievable downhole tool within a wellbore using a debris ring that includes an expandable material. The expandable material may include an expandable metal material, an expandable elastomeric material, or other suitable expandable material for forming the debris barrier. The debris ring may form the debris barrier that may prevent sediment or other types of debris from settling in or around the retrievable downhole tool during wellbore-related tasks. The retrievable downhole tool may include a packer, a hanger, or other tool used to perform wellbore-related tasks and that can be lowered into, and raised out of, the wellbore. In an example in which the expandable material is the expandable metal material, the expandable metal material may include at least one metallic element or at least one metal alloy that, when exposed to wellbore fluid such as brine, may expand to form the debris barrier. In another example in which the expandable material is the expandable elastomeric material, the expandable elastomeric material may include at least one non-metallic element or at least one non-metallic material that, when exposed to the wellbore fluid, may expand to form the debris barrier.

Retrievable downhole tools can be disposed or otherwise positioned downhole in the wellbore to perform wellbore-related tasks. During the wellbore-related tasks, sediment or other types of debris may build-up in or around the retrievable downhole tools. In some examples, the build-up or accumulation of debris can prevent the removal of the retrievable downhole tools or can increase the difficulty of removing the retrievable downhole tools. In some cases, removing retrievable downhole tools that include accumulated debris may cause damage to the retrievable downhole tool, the wellbore, and the like.

A debris ring can be positioned on a mandrel that includes a retrievable downhole tool to prevent or otherwise mitigate the build-up or accumulation of debris. In some examples, the debris ring may include an expandable metal material that can form a debris barrier subsequent to the retrievable downhole tool reaching a desired depth in the wellbore. Once the retrievable downhole tool is positioned in the wellbore at the desired depth, the expandable metal material may undergo an expansion operation when exposed to brine or other wellbore fluid to form the debris barrier. The expansion of the expandable metal material may not be triggered by run-in-hole operations or other fluid circulation operations.

The retrievable downhole tool may include a slip, a wedge, a grooved surface, and other suitable components for performing the wellbore-related tasks. The debris ring may be positioned abutting the wedge such that portions of the retrievable downhole tool receive contact support from the debris ring. The debris ring may be a taut component, and, during run-in-hole operations or swab testing, the debris ring may not be removed or otherwise be disturbed from an original position of the debris ring.

The debris ring may include the expandable metal material, and in some examples, the debris ring may include other materials for altering or improving the performance of the debris ring. For example, the debris ring may include a combination of the expandable metal material and a polymeric material. In this example, the expandable metal material can be a composite with the polymeric material with either the expandable metal material as the continuous phase, in which metal foam is combined with polymer, or with the polymeric material as the continuous phase, in which expandable metal particles are mixed into the polymer.

In other examples, the debris ring may include the expandable metal material and a sheath that includes a non-expandable material. The non-expandable material may include a metallic element or alloy, a polymeric material, or other suitable non-expandable materials. The expandable metal material may be at least partially encapsulated by the non-expandable sheath, and the non-expandable sheath may delay catalytic fluid or material, such as wellbore fluid, from interacting with the expandable metal material. The delay may result in a delayed expansion reaction for forming the debris barrier. For example, a delayed expansion reaction may be used when the retrievable downhole tool that includes the debris ring with the non-expandable sheath is positioned downhole and circulation operations, run-in-hole operations, or other related operations are performed. During the operations, the retrievable downhole tool may be moved or otherwise disturbed, and, if the expansion reaction is not delayed in this example, damage to the wellbore, to the retrievable downhole tool, or a combination thereof could occur.

In some examples, the debris ring may include an expandable elastomeric material. The expandable elastomeric material may include a polymeric material, or other suitable, non-metallic, expandable material. The expandable elastomeric material may, in response to being exposed to the wellbore fluid, expand in a manner similar or identical to the expandable metal material to form the debris barrier. In some examples, the expandable elastomeric material may expand by absorbing the wellbore fluid. The debris barrier formed by the expandable elastomeric material may persist for a similar or identical amount of time, and be similarly or identically effective, compared to the debris barrier formed by the expandable metal material.

The expandable metal material of the debris ring may swell by undergoing hydrolysis reactions in the presence of brines to form metal hydroxides. The metal hydroxide may occupy more space than the base metal reactant. This expansion in volume may allow the expandable metal material to form the barrier at the interface of the expandable metal material and any adjacent surfaces. For example, a mole of magnesium has a molar mass of 24 g/mol and a density of 1.74 g/cm$^3$ which results in a volume of 13.8 cm/mol. Magnesium hydroxide has a molar mass of 60 g/mol and a density of 2.34 g/cm$^3$ which results in a volume of 25.6 cm/mol. 25.6 cm/mol is 85% more volume than 13.8 cm/mol. As another example, a mole of calcium has a molar mass of 40 g/mol and a density of 1.54 g/cm$^3$ which results in a volume of 26.0 cm/mol. Calcium hydroxide has a molar mass of 76 g/mol and a density of 2.21 g/cm$^3$ which results in a volume of 34.4 cm/mol. 34.4 cm/mol is 32% more volume than 26.0 cm/mol. As yet another example, a mole of aluminum has a molar mass of 27 g/mol and a density of 2.7 g/cm$^3$ which results in a volume of 10.0 cm/mol. Aluminum hydroxide has a molar mass of 63 g/mol and a density of 2.42 g/cm$^3$ which results in a volume of 26 cm/mol. 26 cm/mol is 160% more volume than 10 cm/mol.

The expandable metal material may include any metal or metal alloy that may undergo a hydration reaction to form a metal hydroxide of greater volume than the base metal or metal alloy reactant. The metal may become separate particles during the hydration reaction and these separate particles may lock or bond together to form what is considered the expandable metal material. Examples of suitable metals for the expandable metal material include, but are not limited to, magnesium, calcium, aluminum, tin, zinc, beryllium, barium, manganese, or any combination thereof. Examples of suitable metal alloys for the expandable metal material may include, but are not limited to, any alloys of magnesium, calcium, aluminum, tin, zinc, beryllium, barium, manganese, or any combination thereof. Specific examples of the metal alloys can include magnesium-zinc, magnesium-aluminum, calcium-magnesium, or aluminum-copper.

In some examples, the metal alloys may include alloyed elements that are not metallic. Examples of these nonmetallic elements include, but are not limited to, graphite, carbon, silicon, boron nitride, and the like. In some examples, the metal may be alloyed to increase reactivity or to control the formation of oxides. In some examples, the metal alloy may be alloyed with a dopant metal that promotes corrosion or inhibits passivation and thus increases hydroxide formation. Examples of dopant metals include, but are not limited to nickel, iron, copper, carbon, titanium, gallium, mercury, cobalt, iridium, gold, palladium, or any combination thereof.

In examples in which the expandable metal material includes a metal alloy, the metal alloy may be produced from a solid solution process or a powder metallurgical process. The debris barrier that includes the metal alloy may be formed either from the metal alloy production process or through subsequent processing of the metal alloy. As used herein, the term "solid solution" refers to an alloy that is formed from a single melt in which the components in the alloy, such as a magnesium alloy, are melted together in a casting. The casting can be subsequently extruded, wrought, hipped, or worked to form a desired shape for the debris barrier of the expandable metal material. It is to be understood that some minor variations in the distribution of the alloying particles can occur.

A solid solution may be a solid-state solution of one or more solutes in a solvent. Such a mixture may be considered a solution rather than a compound when a crystal structure of the solvent remains unchanged by addition of the solutes and when the mixture remains in a single homogeneous phase. A powder metallurgy process generally includes obtaining or producing a fusible alloy matrix in a powdered form. The powdered fusible alloy matrix is then placed in a mold or blended with at least one other type of particle and then placed into a mold. Pressure may be applied to the mold to compact the powder particles together to fuse them to form a solid material, which may be used as the expandable metal material. In some examples, the expandable metal material may include an oxide. As an example, calcium oxide reacts with water in an energetic reaction to produce calcium hydroxide. One mole of calcium oxide occupies 9.5 cm$^3$ whereas 1 mole of calcium hydroxide occupies 34.4 cm$^3$, which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof. The selected expandable metal material may be selected such that the formed debris barrier does not degrade into the brine. As such, the use of metals or metal alloys for the expandable metal material that form relatively water-insoluble hydration products may be preferred. For example, magnesium hydroxide and calcium hydroxide have low solubility in water.

Additionally, the debris barrier may be positioned in the downhole tool such that degradation into the brine may be constrained due to the geometry of the area in which the debris barrier is disposed and thus resulting in reduced exposure of the debris barrier. For example, the volume of the area in which the expandable metal material is disposed may be less than the expansion volume of the expandable metal material. In some examples, the volume of the area is less than as much as 50% of the expansion volume. Alternatively, the volume of the area in which the debris barrier may be disposed may be less than 90% of the expansion volume, less than 80% of the expansion volume, less than 70% of the expansion volume, or less than 60% of the expansion volume.

In some examples, the metal hydration reaction may include an intermediate step in which the metal hydroxides are small particles. When confined, these small particles may lock together to create the barrier. Thus, there may be an intermediate step where the expandable metal material forms a series of fine particles between the steps of being solid metal and forming a barrier. The small particles may have a maximum dimension less than 0.1 inch and generally have a maximum dimension less than 0.01 inches. In some examples, the small particles include between one and 100 grains (metallurgical grains).

In some examples, the expandable metal material of the debris barrier may be dispersed into a binder material. The binder may be degradable or non-degradable. In some examples, the binder may be hydrolytically degradable. The binder may be expandable or non-expandable. If the binder is expandable, the binder may be oil-expandable, water-expandable, or oil- and water-expandable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycolic acid, nitrile rubber, isoprene rubber, PTFE, silicone, fluroelastomers, ethylene-based rubber, and PEEK. In some embodiments, the dispersed swellable metal may be cuttings obtained from a machining process. In some examples, the metal hydroxide formed from the expandable metal material may be dehydrated under sufficient expanding pressure. For example, if the metal hydroxide resists movement from additional hydroxide formation, elevated pressure may be created which may dehydrate the metal hydroxide. This dehydration may result in the formation of the metal oxide from the expandable metal. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the expandable metal material may allow the expandable metal material to form additional metal hydroxide and continue to expand.

In an example, the brine used to form the metal hydroxides within the wellbore may be saltwater (e.g., water containing one or more salts dissolved therein), saturated saltwater (e.g., saltwater produced from a subterranean formation), seawater, fresh water, or any combination thereof. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines can include, for example, magnesium chloride brines, calcium chloride brines, calcium bromide brines, and the like. In some examples, the salinity of the brine may exceed 10%.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic 100 of a set of retrievable downhole tools 102 having at least one debris ring 104 disposed in a wellbore 106 according to one example of the present disclosure. The debris ring 104 may include an expandable material such as an expandable metal material, an expandable elastomeric material, or other suitable expandable material. At a desired depth, the retrievable downhole tool 102 can be exposed to a wellbore fluid, such as brine, and the debris ring 104 can swell to contact an adjacent wellbore wall 108 to form a debris barrier. In the illustrated example, two retrievable downhole tools 102 having two debris rings 104 are illustrated, but other suitable numbers of retrievable downhole tools 102 or debris rings 104 for performing wellbore-related tasks may be included. As the debris rings 104 form the debris barriers, portions 110 of the wellbore 106 or the retrievable downhole tools 102 may be isolated from other portions of the wellbore 106 or of the retrievable downhole tools 102 to prevent debris from settling in or around the retrievable downhole tools 102.

The debris ring 104 may be positioned on the retrievable downhole tool such that the debris ring 104 abuts a barrier-setting wedge to provide contact support for a system that includes the retrievable downhole tool 102. In some examples, the debris ring may be positioned on a top or upper portion of the retrievable downhole tool 102. In certain examples, the debris ring 104 may include an expandable metal material. In such examples, the expandable metal material may expand to form the debris barrier in the wellbore 106. The debris barrier may be formed by the expandable metal material undergoing a hydrolysis reaction or undergoing a hydrolysis reaction followed by a dehydration reaction. In examples in which the expandable material is the expandable elastomeric material, the debris barrier may be formed in an identical or similar manner as the expandable metal material. In certain examples, the debris ring 104 may include a non-expandable sheath that at least partially encapsulates the expandable material. In other examples, the expandable material included in the debris ring 104 may include a combination of a polymeric material and the expandable metal material.

Figure 2:
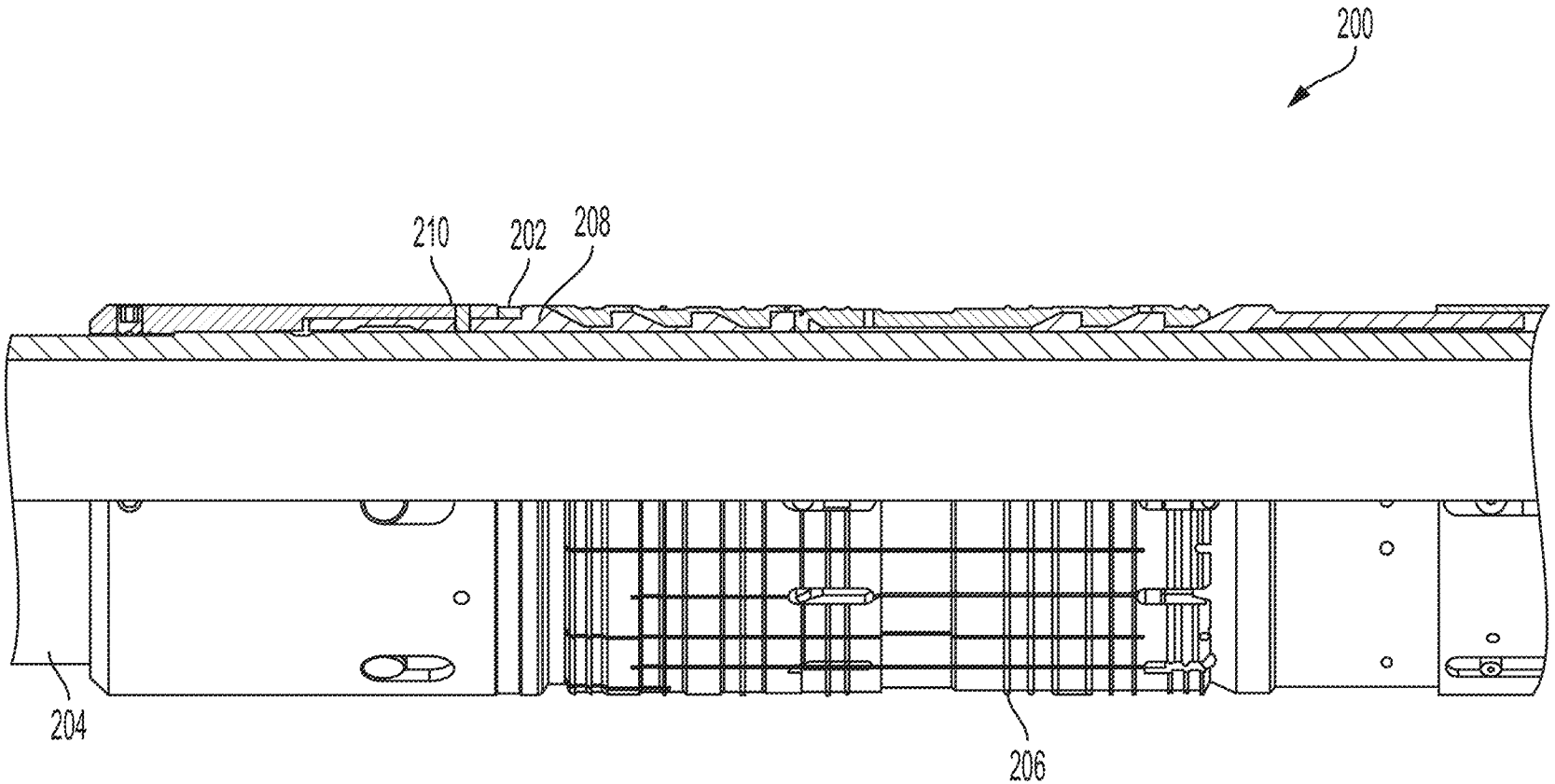
FIG. 2 is a sectional side-view of a retrievable downhole tool that includes a debris ring according to one example of the present disclosure.

FIG. 2 is a sectional side-view of a retrievable downhole tool 200 that includes a debris ring 202 according to one example of the present disclosure. The retrievable downhole tool 200 may include a packer, a liner hanger, a debris dart, a shearable isolation plug, or other suitable downhole tool with a close-fit tolerance between an outer-diameter of the retrievable downhole tool 200 and an inner-diameter of a wall of the wellbore 106. The retrievable downhole tool 200 may additionally include a mandrel 204, a slip 206, a wedge 208, and a shear pin 210. The mandrel 204 may be positioned downhole in the wellbore 106 for allowing the retrievable downhole tool 200 to perform wellbore-related tasks. In some examples, the wellbore-related tasks may involve expanding the slip 206 using the wedge 208 for the slip 206 to come in contact with the wellbore wall 108. Upon completion of the wellbore-related tasks, the slip 206 may retract along the wedge 208 to enable removal of the mandrel 204 and the retrievable downhole tool 200 from the wellbore 106. Upon lifting the mandrel 204 and beginning the process of removing the mandrel 204 and the retrievable downhole tool 200 from the wellbore 106, the shear pin 210 may shear such that the slip 206 and the wedge 208 are able to contract to a diameter that allows for removing the mandrel 204 and the retrievable downhole tool 200 without damage.

The debris ring 202 may include an expandable material that can be positioned around the mandrel 204 such that, when expanded, the expandable material can form a debris barrier that prevents accumulation of sediment or other debris in or around the retrievable downhole tool. The expandable material can be an expandable metal material, and expandable elastomeric material, a combination thereof, or other suitable expandable material for forming the debris barrier. The expandable material may, in response to being exposed to wellbore fluid such as brine, expand to contact the wellbore wall 108 to form the debris barrier. The expandable material may expand over a certain amount of time to form the debris barrier. For example, upon exposure of the expandable material to the wellbore fluid, the expandable material may expand for a period of time spanning hours to spanning several days, and, once done expanding, the expandable material may contact the wellbore wall 108 for forming the debris barrier.

In some examples, the wedge 208 may be a barrier-setting wedge such that the debris ring 202 may be positioned abutting the wedge 208. Once the expandable material of the debris ring 202 has expanded to form the debris barrier, the retrievable downhole tool 200, or a system that includes the retrievable downhole tool 200, may benefit from contact support. Contact support, in this case, may indicate that components including the debris ring 202, the wedge 208, and the slip 206 are in contact with an adjacent component such that contacting sides of adjacent components are parallel. In this manner, the work done by each component may be optimized.

Figure 3:
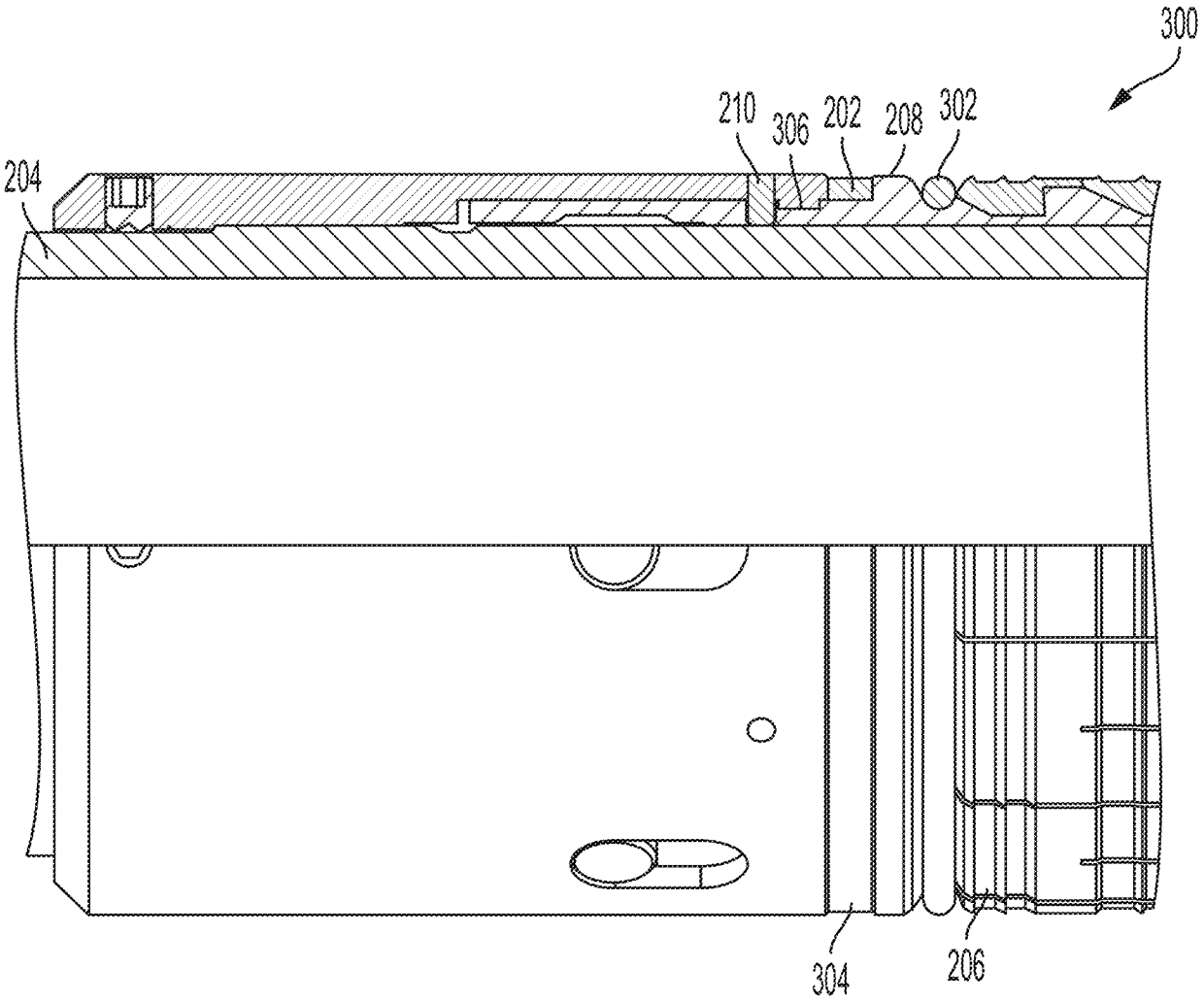
FIG. 3 is a sectional side-view of a portion of a retrievable downhole tool that includes a debris ring and a polymer ring according to one example of the present disclosure.

FIG. 3 is a sectional side-view of a portion 300 of a retrievable downhole tool 200 that includes the debris ring 202 and a polymer ring 302 according to one example of the present disclosure. The portion 300 may additionally include the mandrel 204, the slip 206, the wedge 208, and the shear pin 210. The polymer ring 302 may include a polymeric material such as polytetrafluoroethylene, and the polymer ring 302 may serve as a secondary debris barrier. In some examples, the portion 300 may not include the polymer ring 302. The debris ring 202 may include an expandable material such as the expandable metal material, and the debris ring 202 may additionally include a non-expandable sheath 304 that may partially encapsulate the expandable material. The non-expandable sheath 304 is described further below with respect to FIG. 4.

As described with respect to FIG. 2, the wedge 208 may be a barrier-setting wedge. The debris ring 202 may be positioned such that the debris ring 202 abuts the wedge 208 for providing contact support to the retrievable downhole tool 200 that includes the portion 300, or to a system that includes the retrievable downhole tool 200 that includes the portion 300. The portion 300 of the retrievable downhole tool 200 may additionally include a grooved surface 306 that can be positioned between the wedge 208 and the shear pin 210. The grooved surface 306 may include a recessed surface compared to adjacent surfaces. The grooved surface 306 may allow the mandrel 204 and the retrievable downhole tool 200 that includes the portion 300 to be removed from the wellbore 106. For example, once the mandrel 204 is lifted in an up-hole direction out of the downhole position, the shear pin 210 may shear to cause the slip 206 and the wedge 208 to collapse inward or otherwise contract to allow the mandrel 204 and the retrievable downhole tool 200 to be removed from the wellbore 106 without damage. In some examples, though, the shear pin 210 may not shear in a manner that impacts the debris ring 202. The grooved surface 306 may, in response to shearing of the shear pin 210, interact with the debris ring 202 such that the debris barrier formed by the debris ring 202 is undone to allow the mandrel 204 and the retrievable downhole tool to be removed from the wellbore 106 without damage.

Figure 4:
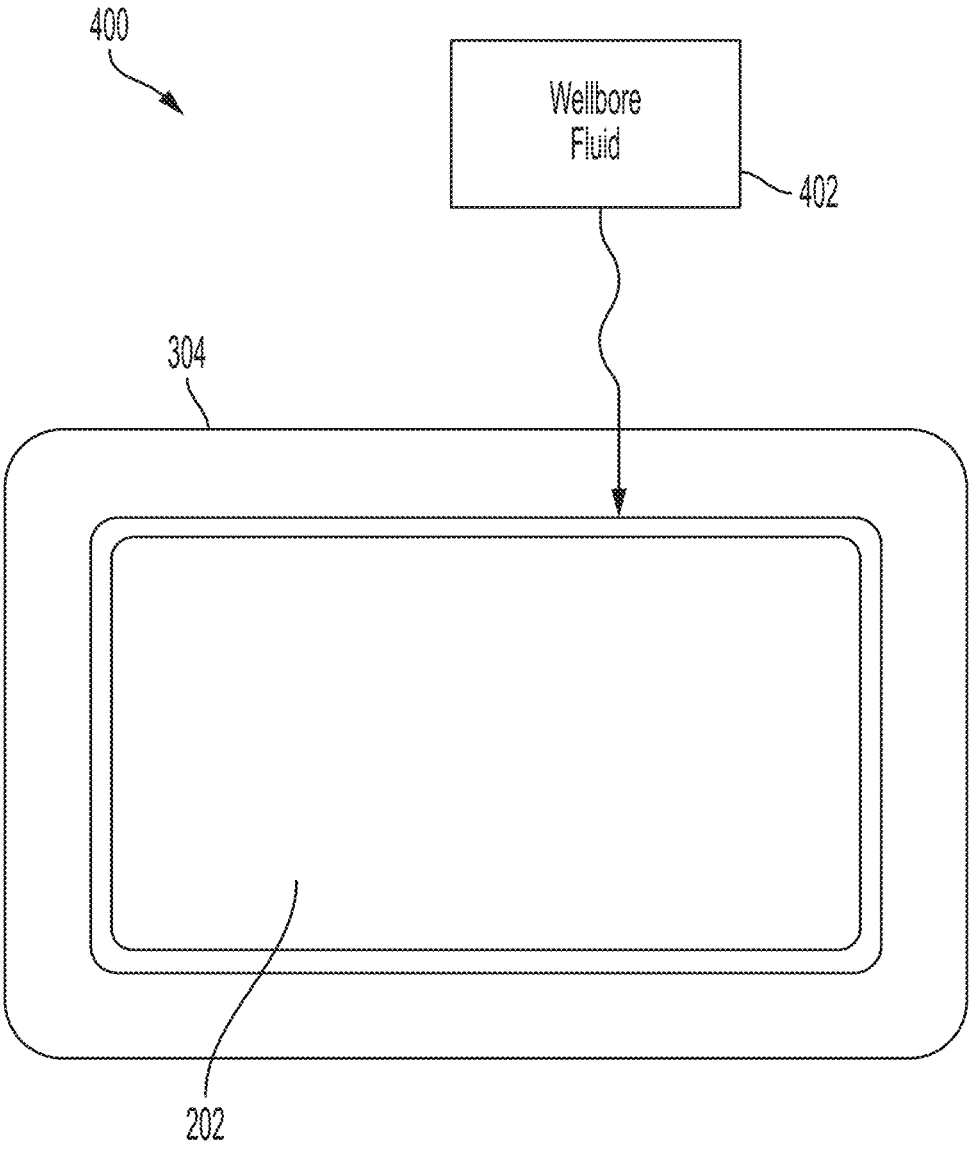
FIG. 4 is a cross-sectional view of an example of a debris ring that is encapsulated by a non-expandable sheath according to one example of the present disclosure.

FIG. 4 is a cross-sectional view of an example 400 of a debris ring 202 that is encapsulated by a non-expandable sheath 304 according to one example of the present disclosure. The non-expandable sheath 304 may include a non-expandable material or a combination of non-expandable materials such as a polymer, a ceramic, an organic material, a metal, a metallic alloy, a combination thereof, or other suitable, non-expandable material. The non-expandable sheath 304 may include an anodizing coating or a plasma electrolytic oxidation coating in which the non-expandable sheath 304 is formed by oxidizing part of the debris ring 202 in an example in which the debris ring 202 includes the expandable metal material.

In some examples, the non-expandable sheath 304 may be hydrophobic, such as a grease or a wax. The non-expandable sheath 304 may result from a physical vapor deposition, or a chemical vapor deposition, process. Further, the non-expandable sheath 304 may be sprayed, dipped, electrodeposited, wetted, applied with an auto-catalytic reaction, vacuum evaporated from solvent, or applied with other suitable techniques. The non-expandable sheath may delay interaction between wellbore fluid 402 and the expandable material, and the delay may allow the retrievable downhole tool 200 that includes the portion 300 to be positioned downhole without damage or premature expansion. The non-expandable sheath 304 may include inhibitors that cause the delay in interaction between the wellbore fluid 402 and the expandable material.

As illustrated, the example 400 of the debris ring 202 includes a non-expandable sheath that fully encapsulates the debris ring 202, but in other examples, the non-expandable sheath may partially encapsulate the debris ring 202. For example, three sides of the debris ring 202 may be positioned abutting a feature of the retrievable downhole tool 200 such as the wedge 208, the slip 206, and the like. As such, the non-expandable sheath 304 may, in this example, be positioned abutting an outward-facing side of the debris ring 202 for partially encapsulating the debris ring 202. Encapsulating the debris ring 202 with the non-expandable sheath 304, whether partially or fully, may cause a delay in forming the debris barrier. For example, in response to being positioned in the wellbore 106, the retrievable downhole tool 200 may be exposed to the wellbore fluid 402. In some examples, causing the debris ring 202 to form the debris barrier right away can lead to damage to the wellbore 106, the retrievable downhole tool 200, and the like. The inhibitors included in the non-expandable sheath 304 may delay forming the debris barrier and, as such, may prevent the damage. When exposed to the wellbore fluid 402, the inhibitors of the non-expandable sheath 304 may physically bond to the wellbore fluid 402, may redirect the wellbore fluid 402, or may otherwise delay migration of the wellbore fluid 402 to the debris ring 202. Upon reaching the debris ring 202, the wellbore fluid 402 may cause the expansion reaction to occur in the debris ring 202 for causing the debris ring 202 to form the debris barrier.

Figure 5:
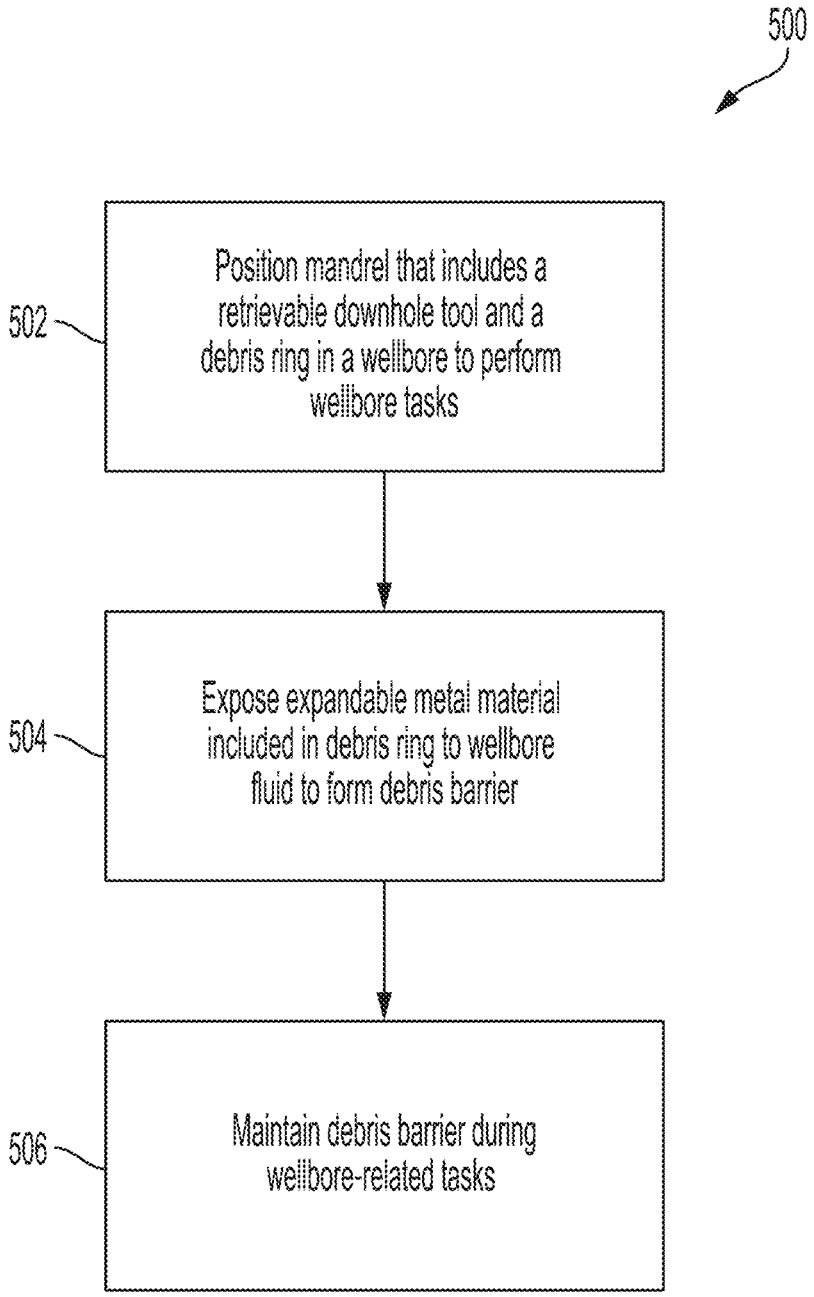
FIG. 5 is a flow chart of a process to form a debris barrier on a retrievable downhole tool according to one example of the present disclosure.

FIG. 5 is a flow chart of a process 500 to form a debris barrier on a retrievable downhole tool 200 according to one example of the present disclosure. At block 502, the process 500 involves positioning a mandrel 204 that includes a retrievable downhole tool 200 and a debris ring 202 in a wellbore 106 to perform wellbore-related tasks. The debris ring 202 may include an expandable material such as an expandable metal material. In some examples, the expandable metal material may be combined with a polymeric material, and in other examples, the expandable metal material may be at least partially encapsulated with a sheath that includes a non-expandable material. In certain examples, the expandable material may include a combination of the expandable metal material and the polymeric material.

At block 504, the process 500 involves exposing the expandable metal material to wellbore fluid to form a debris barrier. The wellbore fluid may include brine or other suitable wellbore fluids or catalytic fluids for causing the expandable metal material to expand to form the debris barrier. Upon exposure to the wellbore fluid, the expandable metal material may expand, may contact the wellbore wall 108, and may form the debris barrier to prevent debris from accumulating in or around the retrievable downhole tool 200.

In an example in which the expandable metal material is at least partially encapsulated by the non-expandable sheath, the expansion of the expandable metal material may be delayed since the wellbore fluid may travel through or around the non-expandable sheath before interacting with the expandable metal material. In this example, the non-expandable sheath may not interact with or otherwise respond to being exposed to the wellbore fluid. In one example, the non-expandable sheath 304 or composition of the debris ring 202, or both may result in preventing expansion of the debris ring 202 until after 30 days of being exposed to the wellbore fluid. Inhibitors may be embedded in the non-expandable sheath, and the inhibitors may delay the expansion reaction that forms the debris barrier. In some examples, the inhibitors may delay the expansion reaction for 30 days, or, in other examples, the inhibitors may delay the expansion reaction for another suitable, pre-set amount of time to, for example, allow proper positioning of the retrievable downhole tool 200 in the wellbore 106.

While the inhibitors delay the expansion reaction, the retrievable downhole tool 200 may be positioned properly and other operations may be performed within the wellbore, such as run-in-hole, swab testing, circulation, or other operations. In this case, the debris ring 202 may be in an unexpanded state that may prevent damage to the retrievable downhole tool 200, the wellbore 106, and the like.

At block 506, the process 500 involves maintaining the debris barrier during the wellbore-related tasks. In response to the debris barrier forming, the debris barrier may be maintained for a period of time. In some examples, the period of time can be a predetermined amount of time that may correspond to, or otherwise be associated with, wellbore-tasks. In other examples, the debris barrier may be manually undone by an operator or supervisor of the wellbore-related tasks. The debris barrier may be undone by lifting on the mandrel 204 in an up-hole direction. Once the mandrel 204 is lifted, the grooved surface 306 positioned on the retrievable downhole tool 200, adjacent to the wedge 208 and to the shear pin 210, may interact with the debris ring 202 such that the debris ring 202 at least partially displaces to cause the debris barrier to be undone.

In some aspects, systems, methods, and debris rings for forming a debris barrier on a retrievable downhole tool in a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a mandrel positionable within a wellbore; a retrievable downhole tool positionable around the mandrel to perform tasks downhole in the wellbore; and a debris ring comprising an expandable material positionable around the mandrel to form a debris barrier in response to exposure of the expandable material to wellbore fluid.

Example 2 is the system of example 1, wherein the expandable material comprises an expandable metal material or an expandable elastomeric material that are interactable with the wellbore fluid to expand to form the debris barrier.

Example 3 is the system of example 1, wherein the retrievable downhole tool further comprises a barrier-setting wedge of a barrier-setting system, and wherein the debris ring is positionable such that the debris ring abuts the barrier-setting wedge to provide contact support for the barrier-setting wedge of the barrier-setting system.

Example 4 is the system of example 1, wherein the debris ring further comprises a polymeric material, wherein the polymeric material is combinable with the expandable material to form an expandable composite material.

Example 5 is the system of example 1, wherein the debris ring further comprises a non-expandable sheath, wherein the non-expandable sheath at least partially encapsulates the expandable material.

Example 6 is the system of example 1, wherein the retrievable downhole tool further comprises a grooved surface positionable adjacent to a barrier-setting wedge to allow the retrievable downhole tool to be removed from the wellbore, wherein the grooved surface is positionable to interact with the debris ring to encourage movement of the debris ring in response to movement of the mandrel in an up-hole direction.

Example 7 is the system of example 1, wherein the debris ring is maintainable in an unexpanded state while being exposed to the wellbore fluid for less than a pre-set amount of time and is expandable to create the debris barrier subsequent to being exposed to the wellbore fluid for the pre-set amount of time.

Example 8 is the system of example 1, wherein the expandable material is an expandable metal material, and wherein the debris barrier is formable using a hydrolysis reaction of an alkaline earth metal or a transition metal of the expandable metal material.

Example 9 is a method comprising: positioning a mandrel within a wellbore, the mandrel comprising a retrievable downhole tool and a debris ring that includes an expandable metal material positioned around the mandrel; exposing the expandable metal material to wellbore fluid to form a debris barrier that abuts a wall of the wellbore from the debris ring; and maintaining the debris barrier during wellbore-related tasks of the retrievable downhole tool.

Example 10 is the method of example 9, wherein exposing the expandable metal material to wellbore fluid to form a debris barrier includes forming the debris barrier using a hydrolysis reaction of an alkaline earth metal or a transition metal of the expandable metal material.

Example 11 is the method of example 9, wherein the debris ring is maintained in an unexpanded state while being exposed to the wellbore fluid for less than a pre-set amount of time and is expanded to create the debris barrier subsequent to being exposed to the wellbore fluid for the pre-set amount of time.

Example 12 is the method of example 9, wherein the retrievable downhole tool includes a barrier-setting wedge, and wherein the debris ring is positionable such that the debris ring abuts the barrier-setting wedge.

Example 13 is the method of example 9, wherein the debris ring includes a polymeric material, wherein the polymeric material is combined with the expandable metal material to form an expandable composite material.

Example 14 is the method of example 9, wherein the debris ring includes a non-expandable sheath, wherein the non-expandable sheath at least partially encapsulates the expandable metal material.

Example 15 is the method of example 9, further comprising removing the retrievable downhole tool from the wellbore by lifting on the mandrel in an up-hole direction, wherein: lifting on the mandrel causes a shear pin to shear and causes the debris ring to at least partially displace into a grooved surface of the mandrel to at least partially remove the debris barrier; and at least partially removing the debris barrier enables efficient removal of the retrievable downhole tool to be removed from the wellbore.

Example 16 is a debris ring, comprising: an expandable metal material positionable around a mandrel and expandable to form a debris barrier in a retrievable downhole tool while downhole in a wellbore in response to exposure of the expandable metal material to wellbore fluid.

Example 17 is the debris ring of example 16, further comprising a non-expandable sheath, wherein the non-expandable sheath comprises a polymer, a ceramic, an organic material, or a metal, and wherein the non-expandable sheath at least partially encapsulates the expandable metal material.

Example 18 is the debris ring of example 16, wherein the retrievable downhole tool includes a barrier-setting wedge, and wherein the debris ring is positionable such that the debris ring abuts the barrier-setting wedge of the retrievable downhole tool.

Example 19 is the debris ring of example 16, further comprising a polymeric material, wherein the polymeric material is combined with the expandable metal material to form an expandable composite material.

Example 20 is the debris ring of example 16, wherein the debris barrier is formable using a hydrolysis reaction of an alkaline earth metal or a transition metal of the expandable metal material.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a mandrel positionable within a wellbore;

a retrievable downhole tool positionable around the mandrel to perform tasks downhole in the wellbore; and a debris ring comprising:

an expandable material positionable around the mandrel to form a debris barrier in response to exposure of the expandable material to wellbore fluid; and a non-expandable sheath that at least partially encapsulates the expandable material, the non-expandable sheath being non-expandable in at least two directions subsequent to the expandable material being exposed to the wellbore fluid, the non-expandable sheath including one or more inhibitors that are physically bondable to the wellbore fluid for causing a delay in interaction between the wellbore fluid and the expandable material.

2. The system of claim 1, wherein the expandable material comprises an expandable metal material or an expandable elastomeric material that are interactable with the wellbore fluid to expand to form the debris barrier.

3. The system of claim 1, wherein the retrievable downhole tool further comprises a barrier-setting wedge of a barrier-setting system, and wherein the debris ring is positionable such that the debris ring abuts the barrier-setting wedge to provide contact support for the barrier-setting wedge of the barrier-setting system.

4. The system of claim 1, wherein the debris ring further comprises a polymeric material, wherein the polymeric material is combinable with the expandable material to form an expandable composite material.

5. The system of claim 1, wherein the retrievable downhole tool further comprises a grooved surface positionable adjacent to a barrier-setting wedge to allow the retrievable downhole tool to be removed from the wellbore, wherein the grooved surface is positionable to interact with the debris ring to encourage movement of the debris ring in response to movement of the mandrel in an up-hole direction.

6. The system of claim 1, wherein the debris ring is maintainable in an unexpanded state while being exposed to the wellbore fluid for less than a pre-set amount of time and is expandable to create the debris barrier subsequent to being exposed to the wellbore fluid for the pre-set amount of time.

7. The system of claim 1, wherein the expandable material is an expandable metal material, and wherein the debris barrier is formable using a hydrolysis reaction of an alkaline earth metal or a transition metal of the expandable metal material.

8. The system of claim 1, wherein the non-expandable sheath is hydrophobic.

9. The system of claim 8, wherein the non-expandable sheath comprises a grease or a wax.

10. A method comprising:

positioning a mandrel within a wellbore, the mandrel comprising a retrievable downhole tool and a debris ring that includes:

an expandable metal material positioned around the mandrel; and a non-expandable sheath that at least partially encapsulates the expandable metal material and that is non-expandable in at least two directions in response to the expandable metal material being exposed to wellbore fluid, the non-expandable sheath including one or more inhibitors that are physically bondable to the wellbore fluid for causing a delay in interaction between the wellbore fluid and the expandable metal material;

exposing the expandable metal material to the wellbore fluid to form a debris barrier that abuts a wall of the wellbore from the debris ring; and maintaining the debris barrier during wellbore-related tasks of the retrievable downhole tool.

11. The method of claim 10, wherein exposing the expandable metal material to wellbore fluid to form a debris barrier includes forming the debris barrier using a hydrolysis reaction of an alkaline earth metal or a transition metal of the expandable metal material.

12. The method of claim 10, wherein the debris ring is maintained in an unexpanded state while being exposed to the wellbore fluid for less than a pre-set amount of time and is expanded to create the debris barrier subsequent to being exposed to the wellbore fluid for the pre-set amount of time.

13. The method of claim 10, wherein the retrievable downhole tool includes a barrier-setting wedge, and wherein the debris ring is positionable such that the debris ring abuts the barrier-setting wedge.

14. The method of claim 10, wherein the debris ring includes a polymeric material, wherein the polymeric material is combined with the expandable metal material to form an expandable composite material.

15. The method of claim 10, further comprising removing the retrievable downhole tool from the wellbore by lifting on the mandrel in an up-hole direction, wherein:

lifting on the mandrel causes a shear pin to shear and causes the debris ring to at least partially displace into a grooved surface of the mandrel to at least partially remove the debris barrier; and at least partially removing the debris barrier enables efficient removal of the retrievable downhole tool to be removed from the wellbore.

16. A debris ring, comprising:

an expandable metal material positionable around a mandrel and expandable to form a debris barrier in a retrievable downhole tool while downhole in a wellbore in response to exposure of the expandable metal material to wellbore fluid; and a non-expandable sheath that at least partially encapsulates the expandable metal material, the non-expandable sheath being non-expandable in at least two directions subsequent to the expandable metal material being exposed to the wellbore fluid, the non-expandable sheath including one or more inhibitors that are physically bondable to the wellbore fluid for causing a delay in interaction between the wellbore fluid and the expandable metal material.

17. The debris ring of claim 16, wherein the non-expandable sheath comprises a polymer, a ceramic, an organic material, or a metal.

18. The debris ring of claim 16, wherein the retrievable downhole tool includes a barrier-setting wedge, and wherein the debris ring is positionable such that the debris ring abuts the barrier-setting wedge of the retrievable downhole tool.

19. The debris ring of claim 16, further comprising a polymeric material, wherein the polymeric material is combined with the expandable metal material to form an expandable composite material.

20. The debris ring of claim 16, wherein the debris barrier is formable using a hydrolysis reaction of an alkaline earth metal or a transition metal of the expandable metal material.

* * * * *